US005304973A

United States Patent [19]

Baldauf et al.

[11] Patent Number: 5,304,973

[45] Date of Patent: Apr. 19, 1994

[54] COIL FOR ELECTROMAGNETICALLY ACTUATING A SWITCHING DEVICE

[75] Inventors: Helmuth Baldauf, Weiden; Gert Fischer, Amberg; Franz Mende, Geberbach; Norbert Zimmermann, Sulzbach-Rosenberg, all of Fed. Rep. of Germany

[73] Assignee: Siemens Aktiengesellschaft, Munich, Fed. Rep. of Germany

[21] Appl. No.: 910,969

[22] Filed: Jul. 9, 1992

[30] Foreign Application Priority Data

Aug. 29, 1991 [DE] Fed. Rep. of Germany ..... 9110706

[51] Int. Cl.[5] ..... H01F 1/00; H01F 15/10; H01H 47/00

[52] U.S. Cl. ..... 335/219; 336/192; 361/142

[58] Field of Search ..... 361/142; 336/192; 335/219, 299

[56] References Cited

U.S. PATENT DOCUMENTS 3,131,331 4/1964 Ray .

FOREIGN PATENT DOCUMENTS 3644113 10/1990 Fed. Rep. of Germany .
9106759 8/1991 Fed. Rep. of Germany .
2629632 10/1989 France .

*Primary Examiner*—Harold Broome
*Attorney, Agent, or Firm*—Kenyon & Kenyon

[57] ABSTRACT

A coil for electromagnetically actuating a switching device. The coil includes terminal connections retained in a coil flange for the coil where there are recesses in the flange to accommodate electrical components. The terminal connections are developed as a joint bar, and the joint bar serves as a mechanical holding device for one of the sides of two diodes of a rectifier bridge configured on opposite sides of the joint bar. The one side of the two diodes is soldered to the joint bar. These elements are inserted as a unit into the recesses of the coil flange.

7 Claims, 2 Drawing Sheets

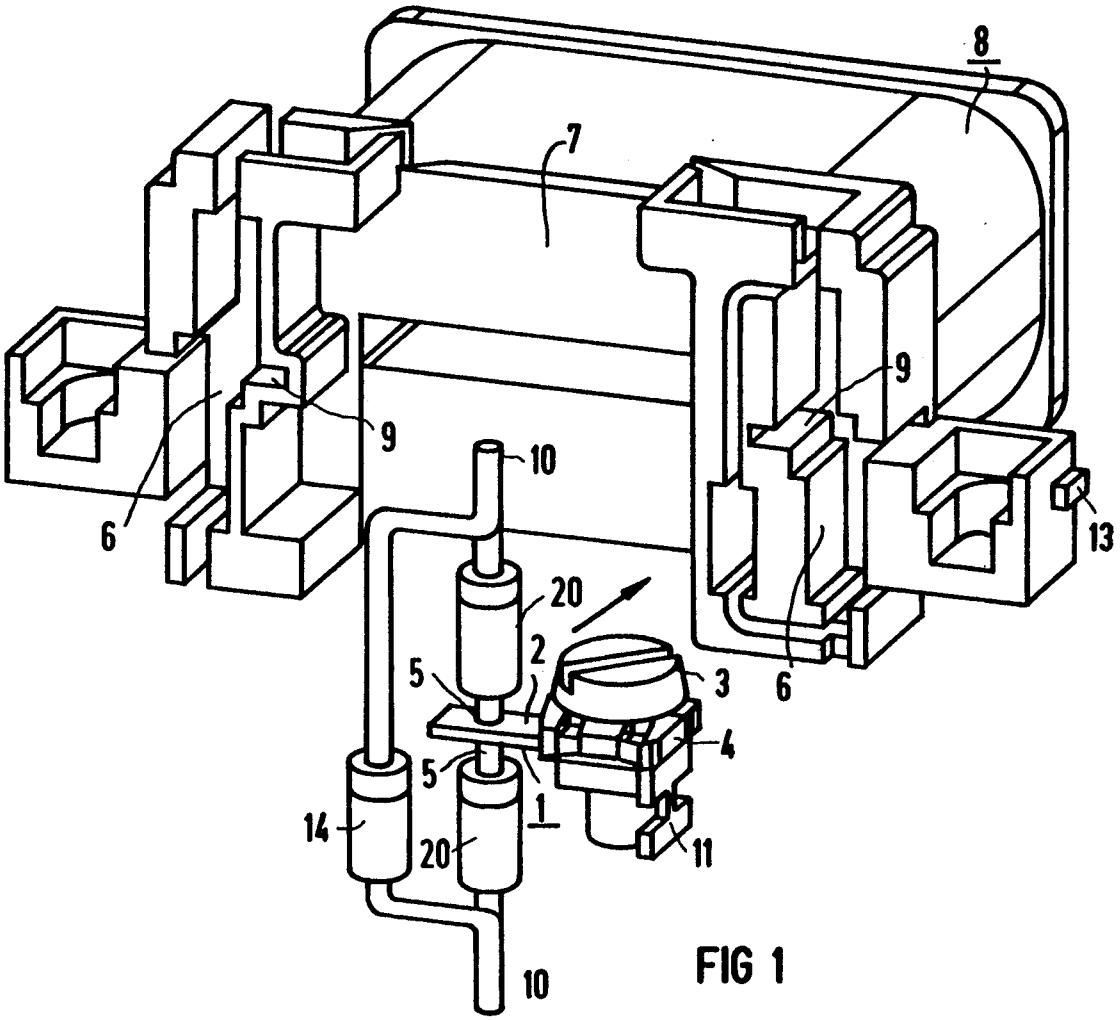
FIG 1
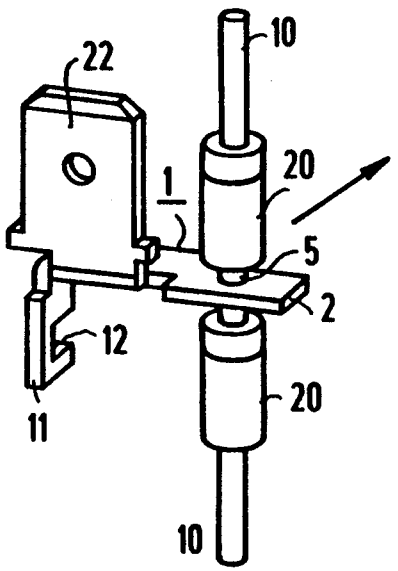

COIL FOR ELECTROMAGNETICALLY ACTUATING A SWITCHING DEVICE

BACKGROUND OF THE INVENTION

The present invention relates to a coil for electromagnetically actuating a switching device. The coil is provided with terminal connections retained in a coil flange for the coil. The coil flange has recesses for accommodating electrical components.

In a known coil for electromagnetically actuating a switching device (German Patent 36 44 113), at two adjacent corner areas of a flange, two terminal posts extend perpendicular to the magnetic field of a winding coil and parallel to each other. Indentations, which are connected with one another via more shallow indentations and which are also connected to the terminal posts, are formed on the outer surface of this end flange such that the voids are formed away from the winding. Electrical or electronic circuit elements can be inserted into these indentations. In this case, the corresponding connecting wires are bent in the corner areas of the flange and, can be soldered together in the installed state.

However, the known coil does not permit simple manufacturing so that production may be difficult to automate.

SUMMARY OF THE INVENTION

The present solution addresses this problem of the above-described known coil. According to a solution provided by the present invention, the coil has terminal connections including a joint bar which serves as a mechanical holding device for one of the sides of the two diodes of a rectifier bridge. The one side of the two diodes are soldered at opposite sides of the joint bar. The terminal connectors are inserted as a unit into cut-outs of the coil flange. It is advantageous to project the other ends of the diodes out over the surface of the flange to attain winding points for winding on the coil. Having the joint bars exhibit insertion openings for the diode connecting wires simplifies the soldering of the diodes to the joint bars. Inserting the joint bars into grooves of the flange advantageously holds the joint bars securely in the coil form under fastening load, when the connecting wires are screwed on. To this end, having the joint bars exhibit outer parts that are bent at right angles and which mate with a positive fit with outer parts of the flange when the joint bars are inserted is further advantageous.

BRIEF DESCRIPTION OF THE DRAWINGS

An exemplified embodiment according to the present invention will be described based on the drawings in which:

FIG. 1 shows an exploded view of an embodiment of the present invention, whereby the joint bars have not yet been inserted into the coil forms;

DETAILED DESCRIPTION

Figure 2:
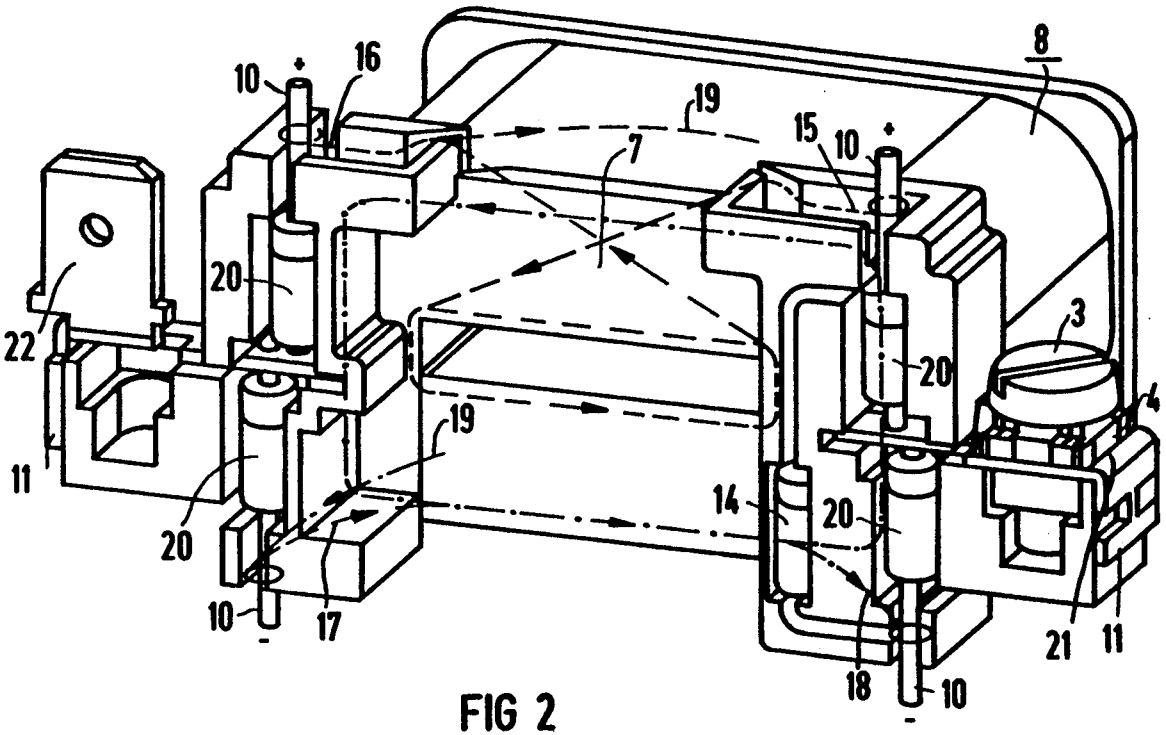
FIG. 2 depicts the completed coil form.

In FIG. 1, the re-fabricated coil connections 1 are depicted outside of the coil form. They include joint bars 2, which on the one hand accommodate terminal screws 3 with clamping plates 4 and, on the other hand, are soldered to one end 5 of diodes 20. The joint bars 2 are provided with insertion openings for the diode ends 5, into which these ends can be inserted before being soldered to the joint bar.

The coil connections 1 prefabricated in this manner are inserted into cut-outs 6 in a flange 7 of the coil body 8. Grooves 9 serve to better retain the joint bars in the coil-form flange. After being inserted into the grooves 9, outer parts 11 of the joint bars 2, which are bent at right angles, embrace extensions 13 on the outer side of the flange 7 with fork-shaped projections 12, thereby achieving a positive-fit mounting support.

Figure 3:
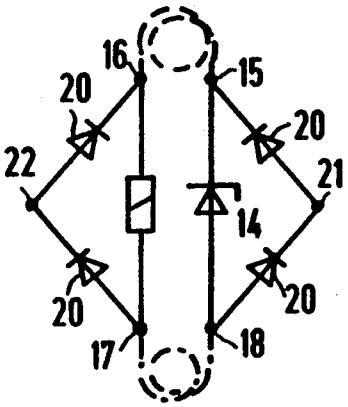
FIG. 3 shows a connecting arrangement for a diode connection associated with the coil form.

The other ends 10 of the diodes project out over the surface of the coil flange (see FIG. 2). The other ends 10 of the diodes are connected to terminal connections of one of the Zener diodes 14 (which serve to limit overvoltage) and are used, furthermore, as winding pins for winding on the coil. The electrical connection of the bridge rectifiers between the points 15, 16 or 17, 18 is accomplished by the winding wire 19 (see FIG. 3). The start of the winding is situated at reference numeral 15 in FIG. 2 at the right upper end 10, and is guided through a winding in the coil form to the point 16, that is the left upper end 10, and led to the further winding of the coil. Points 17 and 18 (i.e., the left and right lower ends 10 of the diodes, respectively) are connected via a winding, in the same way as at the beginning, to the winding end. The points 21, 22 (i.e., the joint bars 2) form the actual coil connections. Since the completed coil is inserted into the housing of the electromagnetic switching device, casting the elements in the coil flange is not required.

The configuration according to the present invention is particularly suited for an automated manufacturing. In place of the screw connections, the joint bars can also be developed as plug-in connections (22), as shown also by the left sides of FIGS. 1 and 2.

What is claimed is:

1. In a coil for electromagnetically actuating a switching device an improvement comprising:

a) a coil flange, said coil flange (i) including a cut-out; and (b) a terminal connector, said terminal connector including (i) two diodes, each of said two diodes including two ends, and (ii) a joint bar, said joint bar serving as a holding device for one end of each of said two diodes, wherein said two diodes form part of a rectifier bridge and said terminal connector is insertable into said cut-out of said coil flange; and wherein said joint bar of said terminal connector further includes an outer part, said outer part being oriented perpendicular to said joint bar and wherein said coil flange further includes an extension such that said outer part and said extension mate with a positive fit when said terminal connector is inserted into said cut-out of said coil flange.

2. The coil as claimed in claim 1, further comprising c) a winding, wherein said coil flange includes a surface and wherein an other end of each of said two diodes project beyond the surface of said coil flange thereby serving as winding points for said winding.

3. The coil as claimed in claim 2, wherein said other end of each of said two diodes are connected via said winding to the bridge of said rectifier bridge.

4. The coil as claimed in claim 2, wherein said other end of each of said two diodes are bridged via a zener diode.

5. The coil as claimed in claim 1, wherein said joint bar includes openings to accommodate said one end of said two diodes.

6. The coil as claimed in claim 1, wherein said coil flange further includes a groove which may accommodate said joint bar.

7. The coil as claimed in claim 1, wherein said coil flange further includes a groove and said joint bar may be inserted into said groove.

* * * * *